US009980058B2

(12) United States Patent
Pedersen et al.

(10) Patent No.: US 9,980,058 B2
(45) Date of Patent: May 22, 2018

(54) METHOD FOR SELECTING TRANSMISSION DIRECTION IN A BINAURAL HEARING AID

(71) Applicant: Oticon A/S, Smørum (DK)

(72) Inventors: Michael Syskind Pedersen, Smørum (DK); Jesper Jensen, Smørum (DK)

(73) Assignee: OTICON A/S, Smørum (DK)

( * ) Notice: Subject to any disclaimer, the term of this patent is extended or adjusted under 35 U.S.C. 154(b) by 7 days.

(21) Appl. No.: 15/204,753

(22) Filed: Jul. 7, 2016

(65) Prior Publication Data

US 2017/0013371 A1 Jan. 12, 2017

(30) Foreign Application Priority Data

Jul. 8, 2015 (EP) ..... 15175907

(51) Int. Cl.
*H04R 25/00* (2006.01)

(52) U.S. Cl.
CPC ..... *H04R 25/552* (2013.01); *H04R 25/305* (2013.01); *H04R 25/407* (2013.01); *H04R 25/505* (2013.01); *H04R 25/554* (2013.01); *H04R 25/558* (2013.01); *H04R 2225/43* (2013.01); *H04R 2225/55* (2013.01)

(58) Field of Classification Search
CPC .... H04R 25/43; H04R 25/407; H04R 25/505; H04R 25/552; H04R 25/554; H04R 25/558; H04R 2225/43; H04R 2225/53; H04R 2225/55; H04R 2430/03; H04R 25/305
USPC ... 381/23.1, 312, 315, 320, 321, 92, 60, 314
See application file for complete search history.

(56) References Cited

U.S. PATENT DOCUMENTS 5,434,924 A * 7/1995 Jampolsky ..... H04R 25/502 381/17
6,549,633 B1 * 4/2003 Westermann ..... H04R 25/453 381/312
2010/0172506 A1 7/2010 Iwano

FOREIGN PATENT DOCUMENTS

EP 2838210 A1 2/2015
WO WO 2010/022456 A1 3/2010
WO WO 2014/048492 A1 4/2014

* cited by examiner

*Primary Examiner* — Huyen D Le
(74) *Attorney, Agent, or Firm* — Birch, Stewart, Kolasch & Birch, LLP

(57) ABSTRACT

The disclosure relates to binaural hearing instruments and more particularly to reduction of processing time required in a binaural hearing aid system. According to the disclosure, there is provided a method comprising mono-directional transmission of data blocks comprising audio and/or information frames from one hearing instrument to the other hearing instrument or vice versa in a binaural hearing aid. According to the disclosure, the direction of transmission is determined by a quantity characterizing the presence of usable information content in the sound signal picked up by the hearing instruments of the binaural hearing aid. It is proposed to use one or more of local SNR, local voice activity detection indication, local level, local speech intelligibility estimate to determine the direction of transmission, although other quantities may be used.

25 Claims, 5 Drawing Sheets

| Δ ≥ T | |
|---|---|
| FQ > SQ | SQ > FQ |
| FQ ≥ H | FQ < L |
| | SQ < H |

| Δ ≥ T | |
|---|---|
| SQ > FQ | FQ > SQ |
| SQ ≥ H | SQ < L |
| | FQ < H |

I
II

One microphone on each side
HV
L
Quantity
505
R
Microphone array on each side
510
L'
R'
515

525
525'
520
520'
530

LV
535
535'
540
545
550

555
560
565
570

METHOD FOR SELECTING TRANSMISSION DIRECTION IN A BINAURAL HEARING AID

FIELD

The present disclosure relates to binaural hearing instruments and more particularly to reducing processing time required in a binaural hearing aid system.

BACKGROUND

It is a problem with currently available solutions that binaural transmission, i.e. transmission between the two hearing instruments of a binaural hearing aid system, creates an additional latency to the hearing aid processing because of signal buffering, quantization, coding, synchronization, etc. Typically, the hearing instruments may either only transmit or receive audio signals at a given time instant. This means that in order to have hearing instruments operate synchronously within a time slot, the hearing instruments are required to wait until the audio signal packages have been transmitted and received at both hearing instruments.

By only transmitting the audio signal in one direction, such processing delay may be reduced, because waiting for an audio package, which is transmitted in the opposite direction will not be necessary. Therefore, in order to design binaural signal processing algorithms (e.g., binaural noise reduction algorithms) which make use of signals sent only in one direction, there is a need to provide a solution to the problem of how to decide, at any given moment, in which direction (i.e. from which hearing instrument to which hearing instrument) the signal is to be sent.

SUMMARY OF THE DISCLOSURE

The hearing instrument, according to the disclosure, includes a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user. Thus, the hearing instrument may be selected from an acoustic hearing aid, bone conduction hearing aid and cochlear implant. The binaural hearing aid includes a combination of these hearing instruments such as a binaural cochlear implant, bimodal hearing aid, binaural acoustic hearing aid, binaural bone conduction hearing aid or other combinations that would be apparent to the person skilled in the art.

When performing binaural signal processing, it is critical that the audio signals are correctly time-aligned at both hearing instruments. Otherwise, the spatial perception may be destroyed or at least disturbed, and consequently also most of the benefit of listening with two ears will be lost or at least deteriorated. Bi-directional communication between the hearing aids provided at the two ears of a user adds some delay to the processing chain, and typically the communication system cannot transmit and receive at the same time. Hereby bi-directional signal processing adds more delay to the processing chain compared to mono-directional (unidirectional) communication, as illustrated in the detailed description of an exemplary embodiment of the present disclosure.

Accordingly a first embodiment, a method for selecting a transmission direction in a binaural hearing aid system comprising two hearing instruments is disclosed. The method includes buffering a first frame of signal samples, at a first hearing instrument, based on a sound signal picked up by one or more input transducers such as microphones of the first hearing instrument. Similarly, at a second hearing instrument, a second frame of signal samples is buffered based on the sound signal picked up by one or more input transducers such as microphones of the second hearing instrument. Thereafter, at the first hearing instrument, determining a first quantity characterizing the presence of usable information content in the sound signal picked up by the one or more input transducers of the first hearing instrument. Similarly, at the second hearing instrument, determining a second quantity characterizing the presence of usable information content in the sound signal picked up by the one or more input transducers of the second hearing instrument. The second quantity is comparable to the first quantity. A comparison is then made between the determined first quantity and the second quantity. Lastly, based on the determined first quantity and/or second quantity and/or the compared first quantity and second quantity, determining the transmission direction for transmitting audio information between the first hearing instrument and the second hearing instrument.

In the disclosure, the quantity refers to presence of usable information content in the sound signal picked up by a microphone(s) whereas the audio information refers to the first frame and/or second frame.

The one or more input transducers such as microphones of the first hearing instrument are positioned at a first ear or in the vicinity of the first ear. Similarly, the one or more input transducers such as microphones of the second hearing instrument are positioned at a second ear or in the vicinity of the second ear. In the vicinity may include a) positioning of microphones in a housing of behind the ear type hearing aids or in the ear/canal type hearing aids, or b) positioning of microphones in external speech processor of cochlear implant, the speech processor typically sitting behind the ear or mounted externally at head over the temporal bone or implanted within the head at temporal bone, or c) positioning of microphones in speech processor of a bone conduction hearing aid such as in softband based solutions/known percutaneous solutions/known transcutaneous solutions.

In one embodiment, the transmission dependent on the determined transmission direction includes transmitting the audio information from the first instrument to the second instrument. Such transmission includes a) coding and transmitting the first frame from the first hearing instrument to the second hearing instrument, b) performing binaural processing of the second frame and a decoded received first frame at the second hearing instrument, thereby providing a binaurally processed output signal from the second hearing instrument and processing the first frame at the first hearing instrument, thereby providing a processed output signal from the first hearing instrument, and c) performing time alignment at the first hearing instrument for synchronizing the output signals.

In another alternative embodiment, the transmission dependent on the determined transmission direction includes transmitting the audio information from the second instrument to the first instrument. Such transmission includes a) coding and transmitting the second frame from the second hearing instrument to the first hearing instrument, b) performing binaural processing of the first frame and a decoded received second frame at the first hearing instrument, thereby providing a binaurally processed output signal from the first hearing instrument and processing the second frame at the second hearing instrument, thereby providing a processed output signal from the second hearing instrument, and c) performing time alignment at the second hearing instrument for synchronizing the output signals, or In yet another embodiment, the transmission dependent on the determined transmission direction includes not transmitting (i.e. preventing transmission of) the audio information between the first instrument and the second instrument. This may occur for example, if both the first quantity and the second quantity are above a predefined high value.

The transmission of the audio information, according to the disclosure, is unidirectional (monodirectional) within a time slot starting from picking of the sound at the first hearing instrument and second hearing instrument until producing the synchronized outputs. The direction of unidirectional transmission is dependent upon the first quantity and/or the second quantity satisfying a predetermined criteria. This is in contrast with the known methods, where during the time slot, the transmission of the audio information is bi-directional, i.e. is both from the first hearing instrument to the second hearing instrument and also from the second hearing instrument to the first hearing instrument.

In one embodiment, the quantity characterizing the presence of usable information content is a local signal-to-noise ratio (SNR) estimated at each of said hearing instruments respectively. In another embodiment, the quantity characterizing the presence of usable information content is a local voice activity detection indication such as a flag set at each of said hearing instruments respectively. In yet another embodiment, the quantity characterizing the presence of usable information content is a local level estimated at each of said hearing instruments respectively. In yet another embodiment, the quantity characterizing the presence of usable information content is a speech intelligibility estimate that is estimated for each ear of binaural hearing aid user. In yet another embodiment, the quantity characterizing the presence of usable information content is a local hearing threshold at each ear of the binaural hearing aid user. In yet another embodiment, the quantity characterizing the presence of usable information content is a combination of any of the previously recited embodiments. The disclosure is presented in relation to the SNR or speech intelligibility estimate but the skilled person would realize that the principles are equally applicable to other or combination of quantities that characterize the usable information.

Thus, in case of a one-directional (mono-directional) audio information transmission, according to an embodiment of the disclosure, the direction of the transmission is made depending on a comparison between the comparable first quantity and second quantity, for example local SNR estimated at each hearing instrument (i.e. at the left and right hearing aid of a binaural hearing aid). A local SNR can e.g. be found using a two-microphone-based single-channel noise reduction system, although other systems or methods may alternatively be used. The local SNR could e.g. be found as a slowly changing frequency weighted average of the SNR estimated in each time-frequency tile.

When listening binaurally to speech in noise, the binaural speech intelligibility is typically determined by the speech intelligibility at the ear with the best signal-to-noise ratio. For example, in noisy situations, people tend to turn one ear towards a talker (sound of interest), which increases the local SNR or sound level of the speech from the talker at one ear, compared to the ear that is on the shadow side of the head relative to the talker or compared to if the HI user faced the talker directly and listened with both ears with nearly equal SNR/sound level. Consequently, from a binaural noise reduction point of view, it makes most sense to spent most effort on enhancing the sound on the high-SNR ear such as the ear turned towards the talker. However, in some instances, for example if the ear having higher SNR demonstrates close to 100% speech intelligibility, then the efforts may applied to the ear having the lower SNR. Therefore, in an illustrative scenario, where each hearing instrument of the binaural hearing aid system includes one microphone each, the total speech intelligibility may be improved by sending the sound from the high SNR ear to the low SNR ear. In general the highest improvement of local SNR may be expected on the side with relatively poor local SNR, i.e. sending the data information from the poor SNR side to the better SNR side will yield a minor improvement at the better SNR side but sending data information from the high SNR side to the relatively poor SNR side will provide a large improvement on the poor SNR side. However, in situation of hearing instrument includes more than one microphones, the more than one microphones may still improve local SNR even in absence of receiving frames from the other hearing instrument. Spatial cues also assist the listener in understanding speech and consequently, lack of spatial cues reduces the speech intelligibility. In cases, where the listener cannot benefit from spatial cues due to a too poor signal to noise ratio at the ear having the lowest signal to noise ratio, it is attempted to enhance the audio signal at the ear that will result in a higher speech intelligibility, thus assisting in determining the transmission direction.

Thus, a relevant factor in determining whether enhancing the ear with the poor SNR or the ear with the high SNR is dependent upon whether the speech intelligibility may be enhanced. For example, if the better ear has an SNR corresponding to close to 100% intelligibility, there might be no reason to improve intelligibility any further at the better ear by binaural transmission because such transmission may degrade spatial perception but listening effort may still be improved. Therefore, improving the SNR at the instrument with the poor SNR makes more sense. On the other hand, if the SNR at better ear does not yield close to 100% speech intelligibility and the SNR at the other ear is even worse, then it is better to improve the SNR at the better ear, hereby maximizing the possibility of obtaining 100% speech intelligibility at the better ear. Accordingly, the following section recites the predetermined criteria according to different embodiments of the disclosure and selection of transmission direction in accordance with the predetermined criteria.

In following embodiments, a difference between the first quantity Q1 and the second quantity Q2 refers to $|Q1-Q2|$ or $|Q2-Q1|$, and threshold T is a positive value.

In one embodiment, when a difference between the first quantity and the second quantity is below a predefined threshold value (T), the transmission direction includes transmitting the audio information from the first hearing instrument to the second hearing instrument or from the second hearing instrument to the first hearing instrument. In the prior situation, local processing of the first frame occurs at the first hearing instrument and binaural processing of the second frame and decoded received first frame occurs at the second hearing instrument. In the latter situation, local processing of the second frame occurs at the second hearing instrument and binaural processing of the first frame and decoded received second frame occurs at the first hearing instrument. Alternatively, when a difference between the first quantity and the second quantity is below a predefined threshold value (T), the transmission direction includes not transmitting audio information between the first instrument and the second instrument. In this situation, the first frame and the second frame are locally processed at the first hearing instrument and the second hearing instrument respectively. Alternatively, when a difference between the first quantity and the second quantity is below a predetermined threshold value (T), a transmission direction from a previous time slot is maintained. The previous time slot is defined as a time slot preceding the time slot in which synchronized output is to be generated. The predefined threshold value (T), for example may be defined as a gap between the two quantities such as SNR gap of 5 dB.

In another embodiment, when the difference between the first quantity and the second quantity is at least the predefined threshold value (T), the transmission direction includes transmitting the audio information from the first hearing instrument to the second hearing instrument if the first quantity is higher than the second quantity and the first quantity is at least a predefined high value (H). In this situation, local processing of the first frame occurs at the first hearing instrument and binaural processing of the second frame and decoded received first frame occurs at the second hearing instrument. Alternatively, when the difference between the first quantity and the second quantity is at least the predefined threshold value (T), transmitting the audio information from the second hearing instrument to the first hearing instrument if the second quantity is higher than the first quantity and the second quantity is at least the predefined high value (H). In this situation, local processing of the second frame occurs at the second hearing instrument and binaural processing of the first frame and decoded received second frame occurs at the first hearing instrument. The predefined high value (H), for example may be defined as a high SNR such as 10 dB and/or close to 100% speech intelligibility. It is apparent that other predefined values may be also be used. In these embodiments, no further enhancement (binaural) may be required at the hearing instrument having the higher quantity but the quantity at the hearing instrument having the lower quantity may be improved using binaural processing.

In yet another embodiment, when the difference between the first quantity and the second quantity is at least the predefined threshold value (T), the transmission direction includes transmitting the audio information from the first hearing instrument to the second hearing instrument if the second quantity is higher than the first quantity and the first quantity is below a predefined low value (L) and second quantity is below the predefined high value (H). In this situation, local processing of the first frame occurs at the first hearing instrument and binaural processing of the second frame and decoded received first frame occurs at the second hearing instrument. Alternatively, when the difference between the first quantity and the second quantity is at least the predefined threshold value (T) the transmission direction includes transmitting the audio information from the second hearing instrument to the first hearing instrument if the first quantity is higher than the second quantity and the second quantity is below the predefined low value (L) and the first quantity is below the predefined high value (H). In this situation, local processing of the second frame occurs at the second hearing instrument and binaural processing of the first frame and decoded received second frame occurs at the first hearing instrument. The predefined low value (L) for example may be defined as a low SNR such as 0 dB or −5 dB. It is apparent that other predefined values may be also be used. In these embodiments, no further enhancement (binaural) may be performed at the hearing instrument having the lower quantity but the quantity at the hearing instrument having the higher quantity may be improved in order to achieve a higher speech intelligibility.

Asymmetric data transmission between two hearing instruments will be described in the detailed description of an exemplary embodiment of the present disclosure. Based on e.g. a comparison between the local SNR estimates from both hearing instruments, a determination of the direction of the audio information transmission between the hearing instruments of the binaural hearing aid system is made.

In an embodiment, the local SNR is determined as a slowly changing frequency weighted average of the SNR estimated in each time-frequency tile. Additionally or alternatively, the speech intelligibility estimate is determined based on the local SNR estimated at each of said hearing instruments and corresponding local hearing threshold at each ear of binaural hearing aid user. The local hearing threshold reflects the hearing ability of the user in different frequency bands and may be based on the user's audiogram for each ear.

In an embodiment, the transmission direction is maintained as the one determined in a previous time slot if the difference between the first quantity and the second quantity is within the predefined threshold (T). This is useful because a change of transmission direction is likely to affect spatial perception without substantially increasing the speech intelligibility.

Even though the audio information transmission may abruptly change direction, it does not necessarily mean that the perceived audio information will have abrupt changes. When a microphone from the opposite hearing instrument becomes available, it may slowly be faded into the local audio processing and similarly when the transmission direction is about to change, the microphone may slowly be faded out resulting in two hearing instruments with local processing when the audio stream is reversed.

According to an embodiment, in order to enable the binaural hearing aid system quickly to decide in which direction (from the first to second hearing instrument or from the second to first hearing instrument) audio information transmission is most beneficial, small data packets containing decision information such as quantity characterizing the useable information is exchanged. This decision information may include, for example local SNR, local sound pressure level, local voice activity detection, information on the expected directional performance (based on the cross correlation between the microphone signals), etc., are exchanged binaurally. The binaural exchange of these very small data packets only increases the total binaural system delay by a very small amount. The binaural exchange of these small data packets and the predetermined criteria enables the binaural hearing aid system to synchronously agree on the audio information transmission direction.

In an embodiment, the quantity characterizing presence of usable information content and the audio information is transmitted using same transmission technique such as using an inductive link. Alternatively, the quantity characterizing presence of usable information content and the audio information is transmitted using different transmission techniques such as using an inductive link for transmitting the audio information and transmitting the quantity characterizing presence of usable information content using a bluetooth link.

In an embodiment, the data packets or blocks including the usable information are exchanged binaurally prior to transmission of associated audio information that are comprised in a separate data packets or blocks. The data packets or blocks containing the usable information is of shorter duration than the separate data packets or blocks containing the audio information.

According to a second embodiment, a hearing instrument for use in a binaural hearing instrument system is disclosed. The hearing instrument includes a transmitter configured to send first data blocks to a second hearing instrument of said binaural hearing aid system. The first data blocks include a first audio and/or a first information including a first quantity characterizing the presence of usable information content in a sound signal picked up by one or more input transducers of the hearing instrument. The hearing instrument further includes a receiver configured to receive second data blocks from the second hearing instrument of said binaural hearing aid system. The second data blocks include a second audio and/or a second information comprising a second quantity characterizing the presence of usable information content in a sound signal picked up by one or more input transducers of the second hearing instrument. The hearing instrument also includes a comparator, a decision unit and a processor. The comparator is configured to compare the first information with the second information, the second information being comparable to the first information. The decision unit is configured to, based on the first information and/or second information and/or the compared first information with the second information, decide whether the hearing instrument sends the first data blocks to the second hearing instrument of the binaural hearing aid system. The processor is configured to either provide local processing of the signal or signal frames picked up by the hearing instrument or to provide binaural processing of the signal or signal frames picked up by the hearing instrument and the signal or signal frames received from the second hearing instrument of the binaural hearing aid system. The decision unit, which may be part of the processor, is configured to instruct the transmitter to send the first data block unidirectionally or instruct the receiver receive the second data block unidirectionally within a time slot starting from picking of the sound at the first hearing instrument (2) and the second hearing instrument (3) until producing the synchronized outputs, the direction of unidirectional transmission being dependent upon the first quantity and/or the second quantity satisfying a predetermined criteria.

In different embodiments, whether the processor performs local processing or binaural processing is dependent upon the first information and/or second information and/or the comparison between the first information and second information and the predetermined criteria.

In an embodiment, the hearing instrument also includes a time-alignment unit configured to provide time alignment or time delay to the signal processed at the hearing instrument such that synchronization of the output signals provided by the hearing instrument and the second hearing instrument of the binaural hearing aid system is achieved.

In an embodiment, the quantity characterizing presence of usable information content and the audio information is transmitted using same transmission technique or different transmission techniques.

In an embodiment, the first information and the second information is selected from a group consisting of local SNR, local voice activity detection indication, local level, local speech intelligibility estimate, local hearing threshold, and any combination thereof.

The decision unit may be configured to decide that only one of either transmission of the first data blocks from the first hearing instrument or receiving the second data blocks from the second hearing instrument within a time slot is performed. The time slot starts from picking of the sound at the first hearing instrument and second hearing instrument until producing the synchronized outputs. Additionally or alternatively, the decision unit may be configured to decide for the time slot, either transmission of the first data blocks to the second hearing instrument or receiving the second data blocks from the second hearing instrument in accordance with the first quantity and/or second quantity and/or the compared first quantity with the second quantity satisfying the predetermined criteria.

According to an embodiment, the hearing instrument includes a two-microphone single-channel noise reduction system configured for estimating the local SNR at the hearing instrument. In yet another embodiment, the local SNR is determined as a slowly changing frequency weighted average of the SNR estimated in each time-frequency tile.

According to a third embodiment, a binaural hearing instrument system including two hearing instruments is disclosed. Each of the hearing instruments may include one or more features that are described above in connection with the hearing instrument of the second embodiment of the disclosure. For example, the second hearing instrument may also include a second transmitter, a second receiver, a second comparator, a decision unit and a second processor. The second hearing instrument may also include a second time alignment unit. Each hearing instrument is configured to carry out the method according to the present disclosure as described above.

In an embodiment, the binaural hearing instrument system is configured such that data packets or blocks comprising the usable information are exchanged binaurally prior to transmission of associated audio information comprised in data packets or blocks, the data packets or blocks being of shorter duration than data packets or blocks.

Thus, the disclosure describes a technique for reducing the overall processing delay in a binaural system. This is achieved by designing a binaural signal processing algorithms (e.g., binaural noise reduction algorithms) that make use of signals sent only in one direction based on the predetermined criteria. Thus, there is provided a method and a system that is able to decide, at any given moment, in which direction (i.e. from which hearing instrument to which hearing instrument) the signal should be sent.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the system and method are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

Figure 1A:
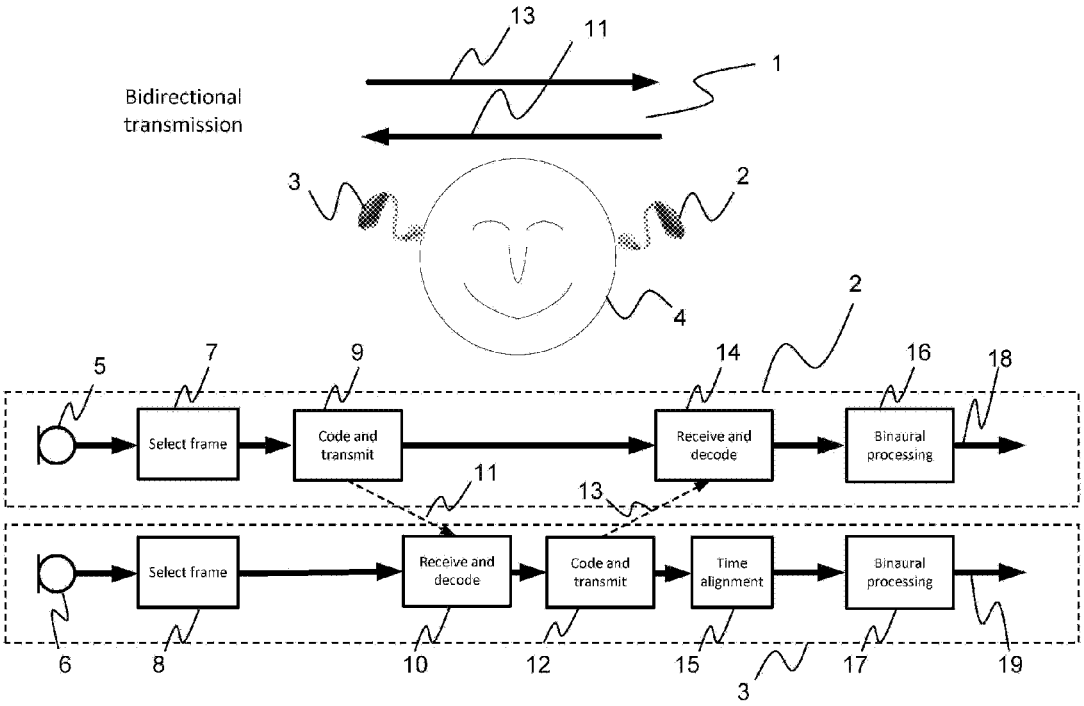
FIG. 1A illustrates transmission of signals between two hearing instruments, where a bi-directional transmission is used, which adds more delay to the processing than if the audio frames are only transmitted in one direction (mono-directional transmission)
Figure 1B:
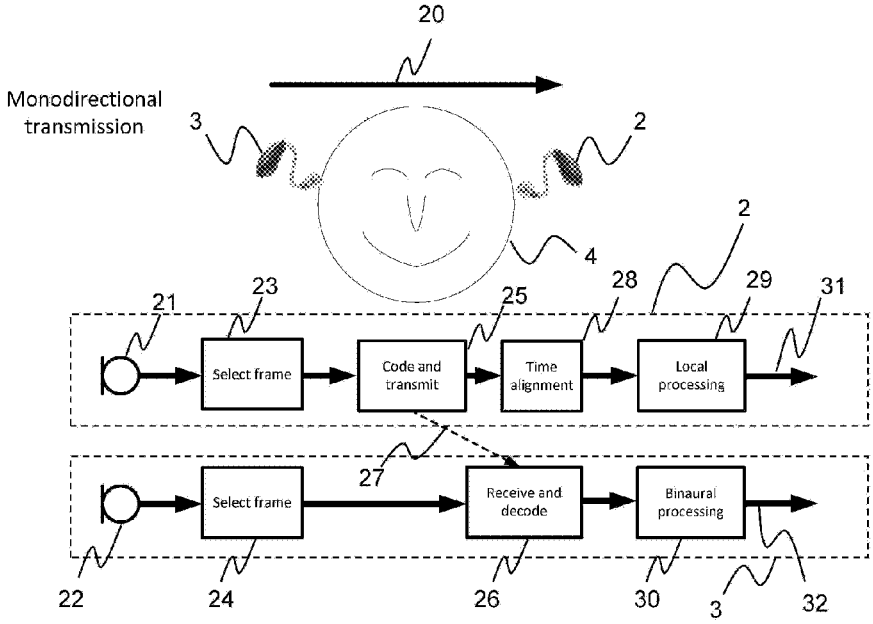
FIG. 1B illustrates mono-directional transmission that reduces the processing delay between the two hearing instruments according to an embodiment of the disclosure.

As described above, when doing binaural signal processing, it is important that the audio signals are correctly time-aligned at both hearing instruments. Otherwise, the spatial perception may be destroyed or at least disturbed, and consequently also most of the benefit of listening with two ears will be lost or at least deteriorated. Communication between the hearing instruments provided at the ears of a user adds some delay to the processing chain, and typically the communication system cannot send and transmit at the same time. Hereby bi-directional signal processing adds more delay to the processing chain compared to mono-directional communication, as illustrated by FIGS. 1A and 1B.

Spatial cues also assist the listener in understanding speech and consequently, lack of spatial cues reduces the speech intelligibility. In cases, where the listener cannot benefit from spatial cues due to a too poor signal to noise ratio at the ear having the lowest signal to noise ratio, it is attempted to enhance the audio signal at the ear that will result in a higher speech intelligibility, thus allowing in determination of the transmission direction. A relevant factor in determining whether enhancing the ear with the poorest SNR or the ear with the highest SNR is dependent upon whether the speech intelligibility may be enhanced.

In the case of a one directional (monodirectional) audio information transmission, according to an embodiment of the present disclosure the direction of the transmission is made depending on a comparison between the local SNR estimated at each hearing instrument. A local SNR can e.g. be found using a two-microphone-based single-channel noise reduction system, although other systems or methods may alternatively be used. The local SNR could e.g. be found as a slowly changing frequency weighted average of the SNR estimated in each time-frequency tile.

As an alternative to the local SNR it is also possible to use the local level estimate, the local voice activity detection indication or any combination hereof.

Figure 2:
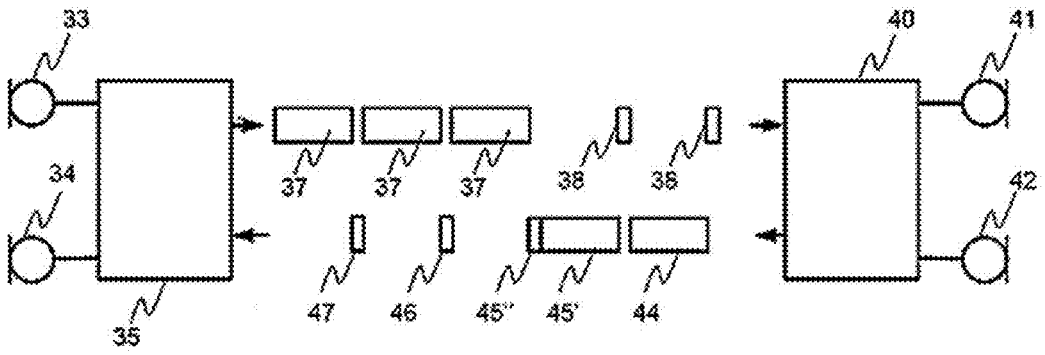
FIG. 2 illustrates audio transmission between two hearing instruments enabling the binaural hearing aid system to quickly decide in which direction (left-to-right or right-to-left) audio information transmission is most beneficial bases on the transmission of small data packets containing decision information exchanged between the two hearing instruments according to an embodiment of the disclosure.

FIG. 2, which (will be described in more detail below) shows such an asymmetric data transmission between two hearing instruments. Based on e.g. a comparison between the local SNR estimates from both hearing instruments, the direction of the audio information transmission is determined.

Even though the audio transmission abruptly may change direction, it does not necessarily mean that the perceived audio will have abrupt changes. When a microphone from the opposite hearing instrument becomes available, it can slowly be faded into the local audio processing and similarly when the transmission direction is about to change, the microphone can slowly be faded out resulting in two hearing instruments with local processing when the audio stream is reversed.

Now, referring to FIG. 1A, when transmitting signals between the two hearing instruments 2 and 3, provided at either ear of the user's head 4, a bidirectional transmission 1 adds more delay to the processing compared to if the audio frames only were transmitted in one direction as illustrated in FIG. 1B, because the transmission line is shared. The illustrated binaural transmission comprises transmission 11 from hearing instrument 2 to 3 and transmission 13 from hearing instrument 3 to 2.

For bi-directional transmission 1 as illustrated in FIG. 1A, the hearing aids 2 and 3 exchange information according to the following procedure:

(a) The two hearing aids 2 and 3, comprising microphones 5 and 6, respectively, buffer a frame of signal samples (e.g. 20 samples) in functional blocks 7 and 8, respectively, based on the sound picked up at the microphones 5 and 6 respectively. It would be apparent to the skilled person that the audio frame (information) transmission may also be performed in the frequency domain.

(b) Hearing aid 2 encodes and transmits its frame to hearing aid 3 as illustrated by functional block 9 and signal transmission 11.

(c) The transmitted frame is received and decoded at hearing aid 3 in the functional block 10 provided herein.

(d) Hearing aid 3 encodes and transmits its frame in functional block 12 provided herein.

(e) The frame of the hearing aid 3 is transmitted 13 to the hearing aid 2, where it is received and decoded in functional block 14 provided herein.

(f) Meanwhile, hearing aid 3 waits for hearing aid 2 to receive the frame. This is accomplished by means of the time-alignment functional block 15 provided in hearing aid 3.

(g) Both hearing aids 2 and 3 process their own and the received signal frame. This binaural processing takes place in functional blocks 16 and 17, respectively.

(h) Finally, the processed signals provided by functional blocks 16 and 17, respectively, are provided at the outputs 18 and 19 of hearing aid 2 and 3, respectively, time-synchronously.

Now, referring to FIG. 1B, mono-directional transmission is illustrated by an example embodiment of the present disclosure. Hearing aid 2 transmits information to hearing aid 3 according to the following procedure:

(a) The two hearing aids 2 and 3, comprising microphones 21 and 22, respectively, buffer a frame of signal samples (e.g. 20 samples) in functional blocks 23 and 24, respectively, based on the sound picked up at the microphones 21 and 22 respectively. It would be apparent to the skilled person that the audio information (frame) transmission may also be performed in the frequency domain.

(b) Hearing aid 2 encodes its frame in functional block 25 and transmits it as indicated by reference numeral 27.

(c) The transmitted frame is received and decoded in functional block 26 in hearing aid 3.

(d) Meanwhile, hearing aid 2 waits for hearing aid 3 to receive the frame. This is accomplished by means of the time-alignment functional block 28 provided in hearing aid 2.

(e) Hearing aid 2 processes its frame in its local processing block 29, while hearing aid 3 processes its own and the received signal frame (reference numeral 27) in the binaural processing block 30.

(f) Finally, the processed signals provided by functional blocks 29 and 30, respectively, are provided at the outputs 31 and 32 of hearing aid 2 and 3, respectively, time-synchronously. Now, referring to FIG. 2 there is illustrated audio information transmission between two hearing instruments 35 and 40, of a binaural hearing aid system. Hearing instrument (HI) 35 comprises two microphones 33 and 34 and hearing instrument (HI) 40 comprises two microphones 41 and 42 as shown. By means of the respective two microphones a local SNR can be found using the two-microphone-based single-channel noise reduction system, although other systems or methods may alternatively be used. The local SNR could e.g. be found as a slowly changing frequency weighted average of the SNR estimated in each time-frequency tile.

Figure 3:
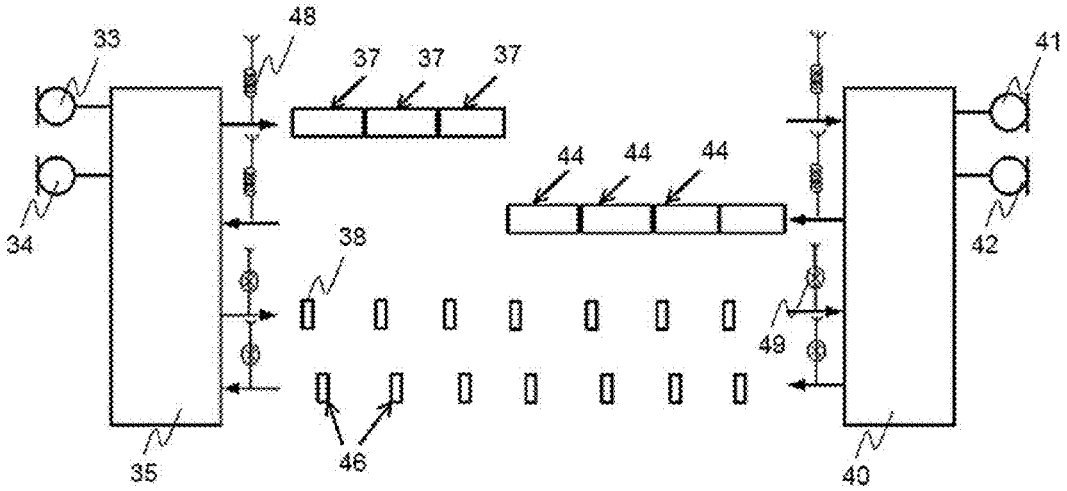
FIG. 3 illustrates different transmission techniques for transmission of audio information and transmission of small data packets containing decision information according to an embodiment of the disclosure.

At a given time instant, the audio information is only transmitted in one direction (i.e. following the scheme illustrated in FIG. 1B). This is done to reduce the total delay of the binaural hearing aid system (i.e., to avoid the scheme illustrated in FIG. 1A). To enable the binaural hearing aid system to quickly decide in which direction (left-to-right, i.e. from HI 35 to HI 40 or right-to-left, i.e. from HI 40 to HI 35) audio information transmission is most beneficial, small data packets 38, 45", 46 and 47 containing usable information such as local SNR, local sound pressure level, local voice activity detection, etc., are exchanged binaurally. The binaural exchange of these very small data packets only increases the total binaural system delay by a very small amount compared to the transmission used in conventional systems as described in FIG. 1A. In different embodiments, the very small data packets (FIGS. 3, 38 and 46) and the audio information (FIG. 3, 37 or 44) are transmitted using same transmission technique such as using an inductive link or are transmitted using different transmission techniques such as using an inductive link (FIG. 3, 48) for transmitting the audio information and transmitting the quantity characterizing presence of usable information content using a bluetooth link (FIG. 3, 49). The binaural exchange of these small data packets enables the binaural hearing aid system to synchronously agree on the audio information transmission direction. The larger data packets (37, 44, 45') include actual audio information. Based on determined direction of transmission, either the large data packets 37 is sent from hearing instrument 35 to the hearing instrument 40 or the large data packet 45', 44 are sent from the hearing instrument 40 to the hearing instrument 35. Each hearing instrument may contain more than one microphone signal for example 2 microphones. For the hearing instrument transmitting audio information, only the local microphones will be available for the audio processing. However, for the instrument receiving the audio information, both the local audio frame and the received audio frame will be available for processing. It is important that the transmitted audio information (frame) is time aligned with the local audio information (frame) in order not to disturb the spatial perception more than necessary.

Figure 4A:
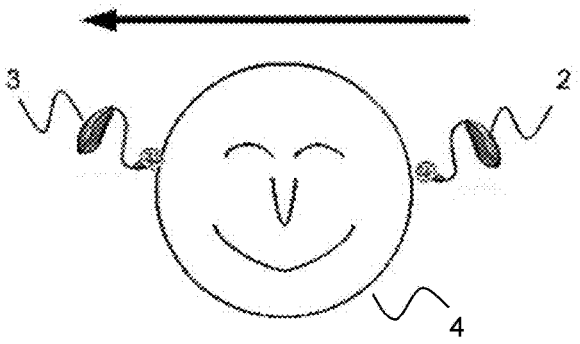
FIG. 4A illustrates the predetermined criteria showing transmission direction from the second hearing instrument to the first hearing instrument according to an embodiment of the disclosure.

FIG. 4A illustrates the predetermined criteria showing transmission direction from the second hearing instrument to the first hearing instrument according to an embodiment of the disclosure. In different embodiments, satisfying a predetermined criteria determines if the transmission direction for transmitting the audio information is from the first hearing instrument (2) to the second hearing instrument (3). In one embodiment (left column of illustrated table), the criteria includes that the difference (A) between the first quantity (FQ) and the second quantity (SQ) is equal or greater than a predefined threshold value T, the first quantity is greater than the second quantity, and the first quantity is at least equal to or greater than the predefined high value (H). This scenario may be visualized as having the first ear having an SNR corresponding to close to 100% intelligibility, therefore there is no reason to improve it any further at the first ear. Therefore, improving the SNR through binaural processing at the second instrument with the poor SNR makes more sense. In another embodiment (right column of illustrated table), the criteria includes that the difference (A) between the first quantity (FQ) and the second quantity (SQ) is equal to or greater than a predefined threshold value T, the second quantity (SQ) is greater than the first quantity (FQ), the first quantity is lower than the predefined low value (L) and the second quantity is lower than the predefined high value (H). This scenario may be visualized as having the second instrument having an SNR that does not yield high such as close to 100% speech intelligibility and the SNR/speech intelligibility at the first ear is even worse, then it is better to improve the SNR at the second ear through binaural processing, hereby maximizing the possibility of obtaining 100% speech intelligibility at the second ear.

Figure 4B:
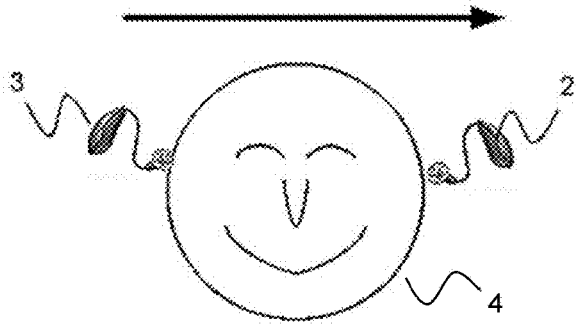
FIG. 4B illustrates the predetermined criteria showing transmission direction from the first hearing instrument to the first hearing instrument according to an embodiment of the disclosure.

FIG. 4B illustrates the predetermined criteria showing transmission direction from the first hearing instrument to the first hearing instrument according to an embodiment of the disclosure. In different embodiments, satisfying a predetermined criteria determines if the transmission direction for transmitting the audio information is from the second hearing instrument (3) to the first hearing instrument (2). In one embodiment (left column of illustrated table), the criteria includes that the difference (Δ) between the first quantity (FQ) and the second quantity (SQ) is equal or greater than a predefined threshold value T, the second quantity is greater than the first quantity, and the second quantity is at least equal to or greater than the predefined high value (H). This scenario may be visualized as having the second ear having an SNR corresponding to close to 100% intelligibility, therefore there is no reason to improve it any further at the second ear. Therefore, improving the SNR through binaural processing at the first instrument with the poor SNR makes more sense. In another embodiment (right column of illustrated table), the criteria includes that the difference (A) between the first quantity (FQ) and the second quantity (SQ) is equal to or greater than a predefined threshold value T, the first quantity (SQ) is greater than the second quantity (FQ), the second quantity is lower than the predefined low value (L) and the first quantity is lower than the predefined high value (H). This scenario may be visualized as having the first instrument having an SNR that does not yield high such as close to 100% speech intelligibility and the SNR/speech intelligibility at the second ear is even worse, then it is better to improve the SNR at the first ear through binaural processing, hereby maximizing the possibility of obtaining 100% speech intelligibility at the first ear.

Figures 5A, 5B, 5C, 5D:
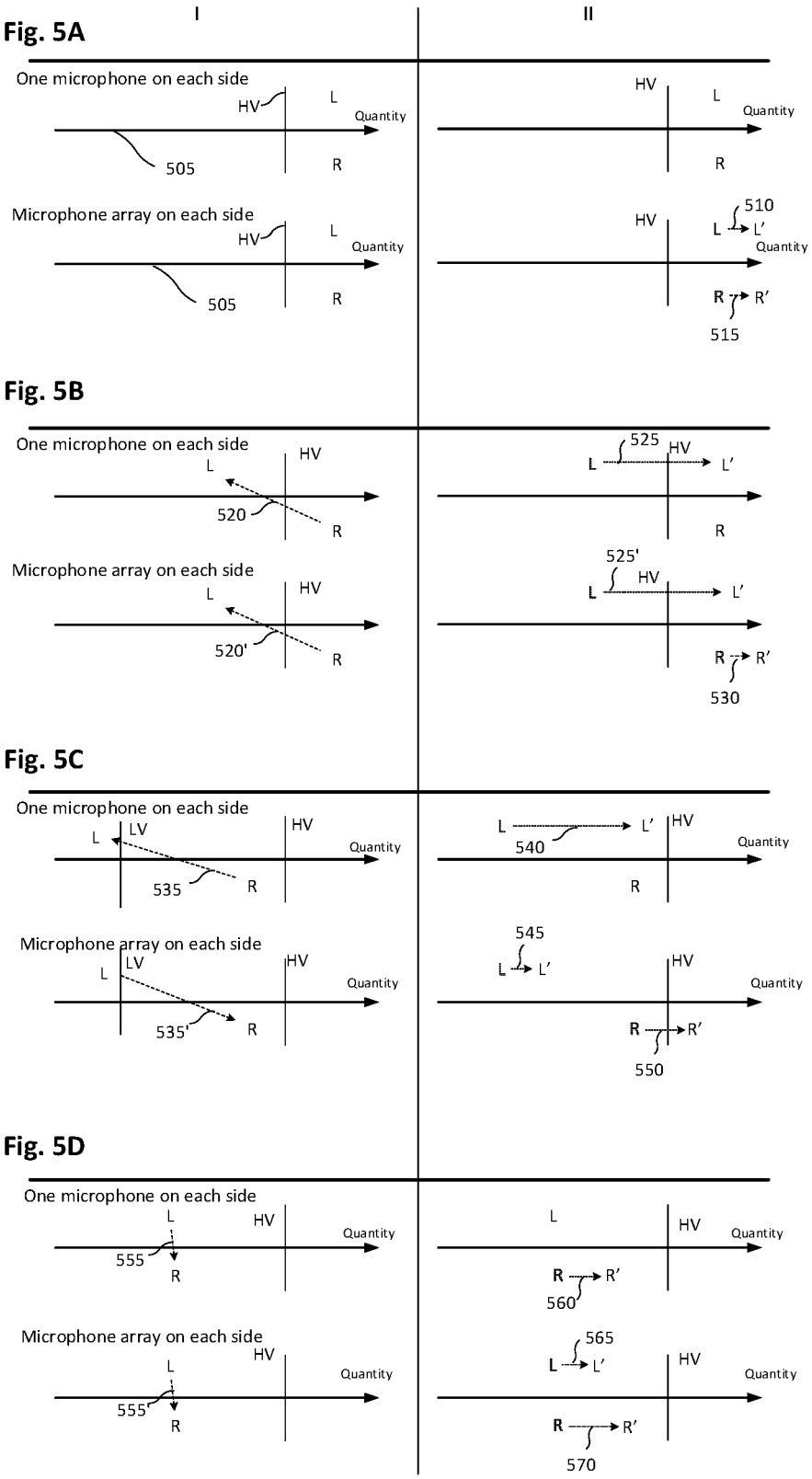
FIG. 5A illustrates transmission direction for hearing instruments each having a single microphone with a specific first quantity and a specific second quantity respectively, and transmission direction for hearing instruments each having a microphone array with the specific first quantity and the specific second quantity respectively according to an embodiment of the disclosure.
FIG. 5B illustrates transmission direction for hearing instruments each having a single microphone with a specific first quantity and a specific second quantity respectively, and transmission direction for hearing instruments each having a microphone array with the specific first quantity and the specific second quantity respectively according to another embodiment of the disclosure.
FIG. 5C illustrates transmission direction for hearing instruments each having a single microphone with a specific first quantity and a specific second quantity respectively, and transmission direction for hearing instruments each having a microphone array with the specific first quantity and the specific second quantity respectively according to yet another embodiment of the disclosure.
FIG. 5D illustrates transmission direction for hearing instruments each having a single microphone with a specific first quantity and a specific second quantity respectively, and transmission direction for hearing instruments each having a microphone array with the specific first quantity and the specific second quantity respectively according to yet another embodiment of the disclosure.

FIG. 5 illustrates transmission direction for different scenarios for a first hearing instrument comprising one microphone and a second hearing instrument comprising one microphone. The figure further illustrates transmission direction for different scenarios for the first hearing instrument comprising a microphone array and the second hearing instrument comprising a microphone array. A line 505 represents the comparable quantity wherein the higher quantity is in increasing direction of the quantity. For example in FIG. 5B, as represented in the I column, the quantity R relating to an instrument is higher than the quantity L relating to the another instrument of the binaural hearing aid system. Thus, L and R represent the measure of quantity at the first hearing instrument (such as left microphone/microphone array) and the second hearing instrument (such as right microphone/microphone array) before directional processing. Column I represents the measure, before directional processing, of the quantity at the first hearing instrument and the second hearing instrument respectively and the transmission direction. Column II represents the effect of the transmission on the first quantity and the second quantity respectively. For illustration purpose, the quantities in these embodiment are explained as speech intelligibility. However, the skilled person would realize that other quantities may also be considered and the disclosed embodiments would be applicable for such other quantities as well.

In FIG. 5A, a high local speech intelligibility estimate is available at both left and right side. In such case, it is not necessary to apply binaural processing, as the local speech intelligibility is sufficiently high. In the case of a single microphone at each ear, there is no SI improvement based on local processing. However, in case of two (or more) local microphones, SI improvement may be achieved based on the local directional enhancement, defining after/post local processing. The value of quantity such as SI estimate before local directional enhancement is referred as "before local processing".

For a one microphone embodiment, both the first quantity (L) and the second quantity (R) are higher than the high value (HV) and no transmission is performed (col. I). Thus, the resulting quantities are unchanged (col. II). For a microphone array embodiment, despite no transmission (col. I), the quantities are improved locally because of the local SNR improvement provided by the individual microphone arrays available at the first hearing instrument and the second hearing instrument. Thus, the quantity L is increased to L' 510 and R to R' 515 as illustrated in col. II.

In FIG. 5B, the estimated speech intelligibility on the right hearing instrument is above a predefined high value, while the intelligibility estimate on the left instrument is below the predefined high value. In this case, the audio information from one of the microphones is transmitted from the right instrument to the left instrument. In the case of a single microphone, all the sound data will be available on the left instrument, and hereby the local speech intelligibility may be improved to a level at least as good as at the right instrument. In the case of two or more microphones, where one of the right microphone signals is transmitted to the left instrument, the speech intelligibility on the left instrument can be improved to a level at least as good as the level at the right instrument, while the speech intelligibility on the right instrument is improved solely by use of local directional processing.

For a single microphone embodiment, as shown in col. I, the quantity R is higher than the high value HV and quantity L is below the high value HV. The transmission direction 520 is from the hearing instrument having the quantity R to the hearing instrument having the quantity L. As a result, as shown in col. II, the quantity L is increased to L' 525 that is higher than the high value, whereas the quantity R is maintained at its original value. For a microphone array embodiment, the transmission direction 520' is from the hearing instrument having the quantity R to the hearing instrument having the quantity L as shown in col. I. This results in increasing the value L to L' 525' that is higher than the high value. However, the microphone array of the hearing instrument having quantity R will still provide local improvement to the quantity R, which is increased to R' 530.

In FIG. 5C, the speech intelligibility on the left instrument is very poor, and the speech intelligibility on the right instrument is poor. In the case of a single microphone in each instrument, the sound is preferably transmitted from the right to the left instrument as the left instrument has the highest potential for improving the intelligibility. However, for some users, it becomes unnatural to have the highest intelligibility on the ear that turns away from the user, and for those, it may be a better choice to improve the intelligibility on the right ear (better ear). In the case of two (or more) microphones on each side, there will be a situation, where it is better to transmit one of the microphone signals from the left (very poor-SI) side to the right (poor SI) side as it hereby is possible to achieve a high SI on at least one ear rather than an improvement to a less high SI level on both sides, which would be the case if the sound was transmitted from the better ear to the less good ear.

For a single microphone embodiment, as shown in col. I, the quantity R is lower than the high value HV and quantity L is below the lower value LV. The transmission direction 535 is from the hearing instrument having the quantity R to the hearing instrument having the quantity L. As a result, as shown in col. II, the quantity L is increased to L' 540 that is closer to the high value, whereas the quantity R is maintained at its original value. Alternatively, the transmission direction may be reversed in order to increase the quantity R such that the increased quantity R is higher than or closer to the high value whereas the value L is maintained at its original value. For a microphone array embodiment, the transmission direction 535' is from the hearing instrument having the quantity L to the hearing instrument having the quantity R as shown in col. I. This results in increasing the value R to R' 550, thus increasing at least one of the quantities beyond the high value HV. This is particularly beneficial to have at least one of the value higher than the high value for improved speech intelligibility. However, the microphone array will provide local improvement to the quantity L, which is increased to L' 545.

In FIG. 5D, an almost equally low level of SI exists on both sides. In this case, there may be an advantage of transmitting the audio information from one side to the other, but as the SI on both sides are close to equal, the transmission direction should not be changed, as a change of transmission direction is likely to give an audible change in the spatial perception. Hereby some hysteresis effect may be allowed in the change of transmission direction.

For a single microphone embodiment, as shown in col. I, both quantities L and R are below the high value, the transmission direction 555 may include transmitting from one hearing instrument to another, typically from hearing instrument having a lower value. This results in improving the quantity R to R' 560. For a microphone array embodiment, the transmission direction 555' results in increasing the quantity R to R' 570 closer to the higher value whereas local microphone array increases the quantity L to L' 565. In view of very close value of the first quantity and the second quantity (within the threshold), the transmission direction may be continued as the one determined in the previous time slot.

In view of FIG. 5, the transmission direction of the audio information is dependent upon increasing at least one quantity higher than or closer to the predefined high value. The phrase higher than the high value refers to increasing a quantity having value below the predefined high value such that receipt and processing of the audio information would result in improving the quantity more than the predefined high value. The phrase closer to the predefined high value refers to increasing quantity having value below the predefined high value such that receipt and processing of the audio information would result in an increased quantity relative to the quantity and the difference between the high value and increased quantity is lower than the difference between the high value and the quantity/high value and local quantity improvement such as by using locally available microphone array. Additionally or alternatively, the transmission direction includes transmitting audio information from the hearing instrument having a higher quantity to the hearing instrument having the lower quantity if the determined higher quantity is higher than the high value.

For a one microphone on each side embodiment, two local speech intelligibility (SI) estimates (or similar comparable quantities such as SNR, listening effort, voice activity) are available. In one embodiment; if both estimates are high such as above the predefined high value, then there is usually no need to transmit any audio information. In another embodiment, if the intelligibility estimate is low such as below predefined high value on one of the sides and significantly lower than the other side such as below the predefined low value, then the transmission may be made from the side with the higher SI to the side with the lower SI in order to achieve acceptable speech intelligibility on both sides. Alternatively, in yet another embodiment, if the intelligibility estimate is low such as below predefined high value on one of the sides and significantly lower than the other side such as below the predefined low value, then the transmission of the audio information from the lower. SI side to the higher SI side may be implemented, hereby increasing SI to highest possible value at the ear that is turned towards the talker.

For hearing instruments individually including more than one microphone, two local speech intelligibility estimates are available, i.e. estimates before local processing and after/post local processing. In this set up, the transmission direction may depend on which ear is expected to provide the highest local speech intelligibility. If only a single audio signal is transmitted between the hearing instruments, not all data will be available on any instrument, and the resulting speech intelligibility on each side will thus also depend on the local speech intelligibility improvement, due to local directional noise reduction. In one embodiment, if both estimates are high such as above the predefined high value, preferably there is no need to transmit any audio information. In another embodiment, the audio information may be transmitted from the high-SI side to the low SI side, when no further improvement is expected on the high-SI instrument such as when the high SI is above the predefined high value. In yet another embodiment, the audio information may be transmitted from the low-SI instrument to the high-SI instrument, when it is expected that the resulting SI on the high-SI instrument would be higher than or closer to the predefined high value or higher than the expected resulting SI on the low-SI instrument if the transmission direction is from the high-SI side to the low-SI side. In a particular microphone array embodiment, the audio information is always transmitted from the low-SI instrument to the high SI-instrument in order to maintain that the ear turned towards the talker also have the highest increased SI.

In an embodiment of two or microphones set up, the method includes i) comparing the post processing quantity i.e. local improvement in quantity because of microphone array available at a hearing instrument and improvement estimated because of receiving the audio information from another hearing instrument, i.e. improvement in quantity because of the disclosed binaural processing, and ii) not performing the disclosed unidirectional transmission of the audio information from the another hearing instrument to the hearing instrument if the comparison result is below a pre-assigned threshold. In this scenario, the transmission direction from a previous time slot may be maintained. However, if the comparison result is equal or above the pre-assigned threshold, then the transmission direction may include the direction that is determined based on any of the other binaural processing embodiments of this disclosure.

In yet another embodiment, the audio transmission direction is always from the high-SI instrument to the low-SI instrument, as the highest local improvement will be achieved at the low-SI side.

The skilled person would realize that in different implementations, the predefined threshold value, predefined high value and predefined low value may be readjusted. Furthermore, these values may also be a function of frequency dependent hearing threshold of the user of the binaural hearing system. Finer classification within the originally proposed threshold, high and low values is also possible in order to determine the transmission direction and is within the scope of this disclosure.

Figure 6:
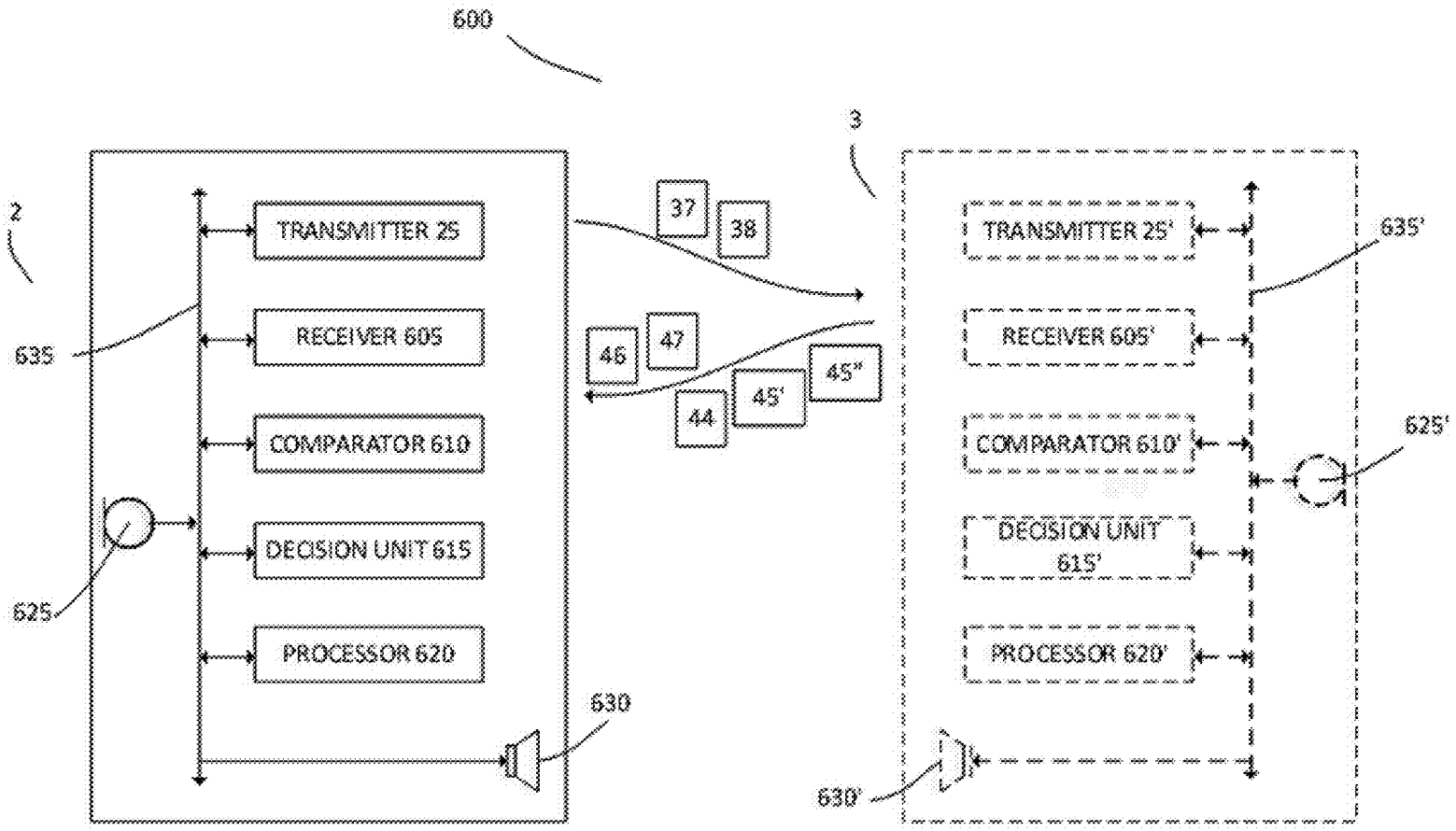
FIG. 6 illustrates a hearing instrument as part of a binaural hearing instrument system according to an embodiment of the disclosure.

FIG. 6 illustrates a hearing instrument 2 as part of a binaural hearing instrument system 600 according to an embodiment of the disclosure. The hearing instrument 2 includes a transmitter 25 configured to send first data blocks (37, 38) to a second hearing instrument (3) of said binaural hearing aid system. The first data blocks includes a first audio and/or a first information comprising a quantity characterizing the presence of usable information content in a sound signal picked up by one or more input transducers 625 of the hearing instrument 2. The hearing instrument further includes a receiver 605 configured to receive second data blocks (44, 45', 45", 46, 47) from the second hearing instrument (3) of said binaural hearing aid system, the second data blocks comprising a second audio and/or a second information comprising a quantity characterizing the presence of usable information content in a sound signal picked up by one or more input transducers of the second hearing instrument. The hearing instrument 2 further includes a comparator 610 configured to compare the first information with the second information, the second information being comparable to the first information, a decision unit 615 configured to, based on the first information and/or second information and/or the compared first information with the second information, decide whether the hearing instrument 2 sends the first data blocks to the second hearing instrument 3 of the binaural hearing aid system. The hearing instrument 2 also includes a processor 620 configured to either provide local processing of the signal or signal frames picked up by the hearing instrument (2) or to provide binaural processing of the signal or signal frames picked up by the hearing instrument (2) and the signal or signal frames received from the second hearing instrument (3) of the binaural hearing aid system. The decision unit 615 is further configured to instruct the transmitter 25 to send the first data block unidirectionally or instruct the receiver receive the second data block unidirectionally within a time slot starting from picking of the sound at the first hearing instrument (2) and the second hearing instrument (3) until producing the synchronized outputs, the direction of unidirectional transmission being dependent upon the first quantity and/or the second quantity satisfying a predetermined criteria. The skilled person would appreciate that the comparator 610 and/or decision unit 615 may be part of the processor 620. Additionally, the time alignment unit may also be part of the processor 620.

In the embodiment, the processor 620 is configured to deliver the locally processed signal or signal frames picked up by the hearing instrument (2) or to deliver binaurally processed signal or signal frames to an output transducer 630 such as a speaker in order to produce stimulation.

In an embodiment, the quantity characterizing presence of usable information content and the audio information is transmitted using same transmission technique or different transmission techniques.

Different components of the first hearing aid (2) are configured to communicate with one another using the communication channel 635.

In an embodiment, a binaural hearing instrument system 600 including two hearing instruments (2, 3) is disclosed. Each of the hearing instruments (2, 3) may include one or more features that are described above in connection with the hearing instrument (2). For example, the second hearing instrument (3) may also include a second transmitter 25', a second receiver 605', a second comparator 610', a decision unit 615' and a second processor 620'. The second hearing instrument may also include a second time alignment unit. The second instrument may also include a microphone 625' and a communication channel 635'. Each hearing instrument is configured to carry out the method according to the present disclosure as described above.

In particular, the hearing instrument 3 includes the transmitter 25' configured to send second data blocks to the first hearing instrument 2 of said binaural hearing aid system 600. The second data blocks includes a second audio and/or a second information comprising a quantity characterizing the presence of usable information content in a sound signal picked up by one or more input transducers 625' of the hearing instrument 3. The hearing instrument 3 further includes a receiver 605' configured to receive first data blocks from the first hearing instrument (2) of said binaural hearing aid system, the second data blocks comprising a first audio and/or a first information comprising a quantity characterizing the presence of usable information content in a sound signal picked up by one or more input transducers of the first hearing instrument.

The comparator 610' is configured to compare the first information with the second information, the second information being comparable to the first information, a decision unit 615' configured to, based on the first information and/or second information and/or the compared first information with the second information, decide whether the hearing instrument 3 sends the second data blocks to the first hearing instrument of the binaural hearing aid system. The hearing instrument also includes a processor 620' configured to either provide local processing of the signal or signal frames picked up by the hearing instrument (3) or to provide binaural processing of the signal or signal frames picked up by the hearing instrument (3) and the signal or signal frames received from the first hearing instrument (2) of the binaural hearing aid system. The decision unit 615 is further configured to instruct the transmitter 25' to send the second data block unidirectionally or instruct the receiver 605' to receive the first data block unidirectionally within a time slot starting from picking of the sound at the first hearing instrument (2) and the second hearing instrument (3) until producing the synchronized outputs, the direction of unidirectional transmission being dependent upon the first quantity and/or the second quantity satisfying a predetermined criteria. The skilled person would appreciate that the comparator 610 and/or decision unit 615 may be part of the processor.

In the embodiment, the processor 620' is configured to deliver the locally processed signal or signal frames picked up by the hearing instrument (3) or to deliver binaurally processed signal or signal frames to an output transducer such as a speaker 630' in order to produce stimulation.

In an embodiment, the binaural hearing instrument system is configured such that data packets or blocks comprising the usable information are exchanged binaurally prior to transmission of associated audio information comprised in data packets or blocks, the data packets or blocks being of shorter duration than data packets or blocks.

It is understood that as used, the singular forms "a," "an," and "the" are intended to include the plural forms as well (i.e. to have the meaning "at least one"), unless expressly stated otherwise. It will be further understood that the terms "includes," "comprises," "including," and/or "comprising,"

when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

We claim:

1. A method for selecting a transmission direction in a binaural hearing aid system comprising two hearing aids, the method comprising at a first hearing aid, buffering a first frame of signal samples based on a sound signal picked up by one or more input transducers of the first hearing aid;

at a second hearing aid, buffering a second frame of signal samples based on the sound signal picked up by one or more input transducers of the second aid;

at the first hearing aid, determining a first quantity characterizing the presence of usable information content in the sound signal picked up by the one or more input transducers of the first hearing aid;

at the second hearing aid, determining a second quantity characterizing the presence of usable information content in the sound signal picked up by the one or more input transducers of the second hearing aid, the second quantity being comparable to the first quantity;

comparing the first quantity with the second quantity; and based on the determined first quantity and/or second quantity and/or the compared first quantity and second quantity, determining the transmission direction for transmitting audio information between the first hearing aid and the second hearing aid, wherein the transmission of the audio information is unidirectional within a time slot starting from picking of the sound at the first hearing aid and second hearing aid until producing synchronized outputs, the direction of unidirectional transmission being dependent upon the first quantity and/or the second quantity satisfying a predetermined criteria.

2. The method according to claim 1, wherein transmission dependent on the determined transmission direction comprises transmitting the audio information from the first hearing aid to the second hearing aid comprising a) coding and transmitting the first frame from the first hearing aid to the second hearing aid, b) performing binaural processing of the second frame and a decoded received first frame at the second hearing aid, thereby providing a binaurally processed output signal from the second hearing aid and processing the first frame at the first hearing aid, thereby providing a processed output signal from the first hearing aid, and c) performing time alignment at the first hearing aid for synchronizing the output signals; or transmitting the audio information from the second hearing aid to the first hearing aid comprising a) coding and transmitting the second frame from the second hearing aid to the first hearing aid, b) performing binaural processing of the first frame and a decoded received second frame at the first hearing aid, thereby providing a binaurally processed output signal from the first hearing aid and processing the second frame at the second hearing aid, thereby providing a processed output signal from the second hearing aid, and c) performing time alignment at the second hearing aid for synchronizing the output signals, or no transmission of the audio information between the first hearing aid and the second hearing aid.

3. The method according to claim 2, wherein the transmission direction of the audio information is dependent upon increasing at least one quantity higher than or closer to a predefined high value; and/or transmitting audio information from the hearing aid having a higher quantity to the hearing aid having the lower quantity if the higher quantity is higher than the high value.

4. The method according to claim 1, wherein each of said first and second quantities characterizing the presence of usable information content is selected from a group consisting of a local signal-to-noise ratio (SNR) estimated at each the corresponding one of said first and second hearing aid, a local voice activity detection indication set at the corresponding one of said first and second hearing aids, a local level estimated at the corresponding one of said first and second hearing aids, a speech intelligibility estimate estimated for a corresponding ear of a binaural hearing aid user, a local hearing threshold at the corresponding ear of the binaural hearing aid user, and any combination thereof.

5. The method according to claim 1, wherein when a difference between the first quantity and the second quantity is below a predefined threshold value (T), the transmission direction comprises transmitting the audio information from the first hearing aid to the second hearing aid or from the second hearing aid to the first hearing aid; or no transmission between the first hearing aid and the second hearing aid; or maintaining a transmission direction from a previous time slot.

6. The method according to claim 1, wherein when the difference between the first quantity and the second quantity is at least a predefined threshold value (T), the transmission direction comprises transmitting the audio information from the first hearing aid to the second hearing aid if the first quantity is higher than the second quantity and the first quantity is at least a predefined high value; or transmitting the audio information from the second hearing aid to the first hearing aid if the second quantity is higher than the first quantity and the second quantity is at least the predefined high value.

7. The method according to claim 1, wherein when the difference between the first quantity and the second quantity is at least the predefined threshold value, the transmission direction comprises transmitting the audio information from the first hearing aid to the second hearing aid if the second quantity is higher than the first quantity and the first quantity is below a predefined low value and second quantity is below the predefined high value; or transmitting the audio information from the second hearing aid to the first hearing aid if the first quantity is higher than the second quantity and the second quantity is below the predefined low value and the first quantity is below the predefined high value.

8. The method according to claim 1, wherein the first and second quantities characterizing presence of usable information content and the audio information are transmitted using a same transmission technique or different transmission techniques.

9. The method according to claim 1, wherein data packets or blocks comprising usable information are exchanged binaurally prior to transmission of associated audio information comprised in data packets or blocks, the data packets or blocks comprising the usable information being of shorter duration than data packets or blocks comprising the associated audio information.

10. A hearing aid for use in a binaural hearing aid system, the hearing aid comprising:

a transmitter configured to send first data blocks to a second hearing aid of said binaural hearing aid system, the first data blocks comprising a first audio and/or a first information comprising a first quantity characterizing the presence of usable information content in a sound signal picked up by one or more input transducers of the hearing aid;

a receiver configured to receive second data blocks from the second hearing aid of said binaural hearing aid system, the second data blocks comprising a second audio and/or a second information comprising a second quantity characterizing the presence of usable information content in a sound signal picked up by one or more input transducers of a second hearing aid;

a comparator configured to compare the first information with the second information, the second information being comparable to the first information;

a decision unit configured to, based on the first information and/or second information and/or the compared first information with the second information, decide whether the hearing aid sends the first data blocks to the second hearing aid of the binaural hearing aid system; and a processor configured to either provide local processing of signal or signal frames picked up by the hearing aid or to provide binaural processing of the signal or signal frames picked up by the hearing aid and the signal or signal frames received from the second hearing aid of the binaural hearing aid system, wherein the decision unit is configured to instruct the transmitter to send the first data block unidirectionally or instruct the receiver receive the second data block unidirectionally within a time slot starting from picking of the sound at the hearing aid and the second hearing aid until producing the synchronized outputs, the direction of unidirectional transmission being dependent upon the first quantity and/or the second quantity satisfying a predetermined criteria.

11. The hearing aid according to claim 10, further comprising a time-alignment unit configured to provide time alignment or time delay to the signal processed at the hearing aid such that synchronization of the output signals provided by the hearing aid and the second hearing aid of the binaural hearing aid system is achieved.

12. The hearing aid according to claim 10, wherein each of the first and second quantities characterizing presence of usable information content and the audio information is transmitted using same transmission technique or different transmission techniques.

13. The hearing aid according to claim 10, wherein the first information and the second information is selected from a group consisting of local SNR, local voice activity detection indication, local level, local speech intelligibility estimate, local hearing threshold and any combination thereof.

14. The hearing aid according to claim 10, wherein the decision unit is configured to decide only one of either transmission of the first data blocks from the hearing aid instrument or receiving the second data blocks from the second hearing aid within a time slot starting from picking of the sound at the first hearing aid and second hearing aid until producing the synchronized outputs.

15. A hearing aid for use in a binaural hearing aid instrument system, the hearing aid comprising:

a transmitter configured to send first data blocks to a second hearing aid of said binaural hearing aid system, the first data blocks comprising a first audio and/or a first information comprising a quantity characterizing the presence of usable information content in a sound signal picked up by one or more input transducers of the hearing aid;

a receiver configured to receive second data blocks from the second hearing aid of said binaural hearing aid system, the second data blocks comprising a second audio and/or a second information comprising a quantity characterizing the presence of usable information content in a sound signal picked up by one or more input transducers of the second hearing aid;

a comparator configured to compare the first information with the second information, the second information being comparable to the first information;

a decision unit configured to, based on the first information and/or the second information and/or the compared first information with the second information, decide whether the hearing aid sends the first data blocks to the second hearing aid of the binaural hearing aid system; and a processor configured to either provide local processing of the signal or signal frames picked up by the hearing aid or to provide binaural processing of the signal or signal frames picked up by the hearing aid and the signal or signal frames received from the second hearing aid of the binaural hearing aid system, wherein the decision unit is configured to instruct the transmitter to send the first data block unidirectionally or instruct the receiver receive the second data block unidirectionally within a time slot starting from picking of the sound at the hearing aid and the second hearing aid until producing synchronized outputs, the direction of unidirectional transmission being dependent upon the first quantity and/or the second quantity satisfying a predetermined criteria, wherein the decision unit is configured to decide for the time slot, either transmission of the first data blocks to the second hearing aid or receiving the second data blocks from the second hearing aid.

16. A binaural hearing aid system comprising two hearing aids, the two hearing aids comprising a first hearing aid and a second hearing aid, wherein each of the first and second hearing aids comprises:

one or more input transducers;

a transmitter configured to send first data blocks to the other of the first and second hearing aids of said binaural hearing aid system, the first data blocks comprising a first audio and/or a first information comprising a quantity characterizing the presence of usable information content in a sound signal picked up by the one or more input transducers;

a receiver configured to receive second data blocks from the other of the first and second hearing aids of said binaural hearing aid system, the second data blocks comprising a second audio and/or a second information comprising a quantity characterizing the presence of usable information content in a sound signal picked up by one or more input transducers of the other of the first and second hearing aids;

a comparator configured to compare the first information with the second information, the second information being comparable to the first information;

a decision unit configured to, based on the first information and/or second information and/or the compared first information with the second information, decide whether to send the first data blocks to the other of the first and second hearing aids of the binaural hearing aid system; and a processor configured to either provide local processing of the signal or signal frames picked up by the one or more input transducers or to provide binaural processing of the signal or signal frames picked up by the one or more input transducers and the signal or signal frames received from the second hearing aid of the binaural hearing aid system, wherein the decision unit is configured to instruct the transmitter to send the first data block unidirectionally or instruct the receiver to receive the second data block unidirectionally within a time slot starting from picking of the sound at the first hearing aid and the second hearing aid until producing synchronized outputs, the direction of unidirectional transmission being dependent upon the first quantity and/or the second quantity satisfying a predetermined criteria.

17. The binaural hearing aid system according to claim 16, wherein data packets or blocks comprising usable information are exchanged binaurally prior to transmission of associated audio information comprised in data packets or blocks, the data packets or blocks comprising the usable information being of shorter duration than data packets or blocks comprising the associated audio information.

18. A method for selecting a transmission direction in a binaural hearing aid system comprising two hearing aids, the method comprising at a first hearing aid, buffering a first frame of signal samples based on a sound signal picked up by one or more input transducers of the first hearing aid;

at a second hearing aid, buffering a second frame of signal samples based on the sound signal picked up by one or more input transducers of the second hearing aid;

at the first hearing aid, determining a first quantity characterizing the presence of usable information content in the sound signal picked up by the one or more input transducers of the first hearing aid;

at the second hearing aid, determining a second quantity characterizing the presence of usable information content in the sound signal picked up by the one or more input transducers of the second hearing aid, the second quantity being comparable to the first quantity;

comparing the first quantity with the second quantity; and based on the determined first quantity and/or second quantity and/or the compared first quantity and second quantity, determining the transmission direction for transmitting audio information between the first hearing aid and the second hearing aid, wherein data packets or blocks comprising usable information are exchanged binaurally prior to transmission of associated audio information comprised in data packets or blocks, the data packets or blocks comprising the usable information being of shorter duration than data packets or blocks comprising the associated audio information.

19. The method according to claim 18, wherein transmission dependent on the determined transmission direction comprises transmitting the audio information from the first aid to the second aid comprising a) coding and transmitting the first frame from the first hearing aid to the second hearing aid, b) performing binaural processing of the second frame and a decoded received first frame at the second hearing aid, thereby providing a binaurally processed output signal from the second hearing aid and processing the first frame at the first hearing aid, thereby providing a processed output signal from the first hearing aid, and c) performing time alignment at the first hearing aid for synchronizing the output signals; or transmitting the audio information from the second aid to the first aid comprising a) coding and transmitting the second frame from the second hearing aid to the first hearing aid, b) performing binaural processing of the first frame and a decoded received second frame at the first hearing aid, thereby providing a binaurally processed output signal from the first hearing aid and processing the second frame at the second hearing aid, thereby providing a processed output signal from the second hearing aid, and c) performing time alignment at the second hearing aid for synchronizing the output signals, or no transmission of the audio information between the first aid and the second aid.

20. The method according to claim 19, wherein the transmission direction of the audio information is dependent upon increasing at least one quantity higher than or closer to a predefined high value; and/or transmitting audio information from the hearing aid having a higher quantity to the hearing aid having the lower quantity if the higher quantity is higher than the high value.

21. The method according to claim 18, wherein each of said first and second quantities characterizing the presence of usable information content is selected from a group consisting of a local signal-to-noise ratio (SNR) estimated at the corresponding one of said first and second hearing aids, a local voice activity detection indication set at the corresponding one of said first and second hearing aids, a local level estimated at the corresponding one of said first and second hearing aids, a speech intelligibility estimate estimated for a corresponding ear of a binaural hearing aid user, a local hearing threshold at the corresponding ear of the binaural hearing aid user, and any combination thereof.

22. The method according to claim 18, wherein when a difference between the first quantity and the second quantity is below a predefined threshold value, the transmission direction comprises transmitting the audio information from the first hearing aid to the second hearing aid or from the second hearing aid to the first hearing aid; or no transmission between the first aid and the second aid; or maintaining a transmission direction from a previous time slot.

23. The method according to claim 18, wherein when the difference between the first quantity and the second quantity is at least a predefined threshold value, the transmission direction comprises transmitting the audio information from the first hearing aid to the second hearing aid if the first quantity is higher than the second quantity and the first quantity is at least a predefined high value; or transmitting the audio information from the second hearing aid to the first hearing aid if the second quantity is higher than the first quantity and the second quantity is at least the predefined high value.

24. The method according to claim 18, wherein when the difference between the first quantity and the second quantity is at least the predefined threshold value, the transmission direction comprises transmitting the audio information from the first hearing aid to the second hearing aid if the second quantity is higher than the first quantity and the first quantity is below a predefined low value and second quantity is below the predefined high value; or transmitting the audio information from the second hearing aid to the first hearing aid if the first quantity is higher than the second quantity and the second quantity is below the predefined low value and the first quantity is below the predefined high value.

25. The method according to claim 18, wherein the first and second quantities characterizing presence of usable information content and the audio information are transmitted using a same transmission technique or different transmission techniques.

* * * * *